US006429821B1

(12) United States Patent
Lewis, Jr.

(10) Patent No.: US 6,429,821 B1
(45) Date of Patent: Aug. 6, 2002

(54) LOW PROFILE, BROAD BAND MONOPOLE ANTENNA WITH INDUCTIVE/RESISTIVE NETWORKS

(75) Inventor: John R. Lewis, Jr., Little Mountain, SC (US)

(73) Assignee: Shakespeare Company, Newberry, SC (US)

( * ) Notice: Subject to any disclaimer, the term of this patent is extended or adjusted under 35 U.S.C. 154(b) by 0 days.

(21) Appl. No.: 09/416,845

(22) Filed: Oct. 12, 1999

(51) Int. Cl.[7] ..... H01Q 9/00
(52) U.S. Cl. ..... 343/749; 343/752; 343/850
(58) Field of Search ..... 343/749, 752, 343/745, 850, 856, 715, 860; H01Q 9/00

(56) References Cited

U.S. PATENT DOCUMENTS

| | | | | |
|---|---|---|---|---|
| 4,229,743 A | * | 10/1980 | Vo et al. | 343/749 |
| 4,328,501 A | * | 5/1982 | DeSantis et al. | 343/749 |
| 4,366,485 A | * | 12/1982 | Hodgekinson | 343/791 |
| 4,443,803 A | * | 4/1984 | DeSantis et al. | 343/749 |
| 4,890,116 A | | 12/1989 | Lewis, Jr. | 343/749 |
| 4,958,164 A | | 9/1990 | Lewis, Jr. | 343/749 |
| 5,089,827 A | * | 2/1992 | Pizon | 343/715 |
| 5,179,387 A | | 1/1993 | Wells | 343/895 |
| 5,600,335 A | * | 2/1997 | Abramo | 343/749 |
| 5,841,407 A | * | 11/1998 | Birnbaum | 343/895 |

OTHER PUBLICATIONS

Shakespeare Company, *Military Communications*, pp. 1–12, 1996.
Jerry Sevick, *Transmission Line Transformers*, 2d Edition, Chapter 6, pp. 6–1 through 6–17; 1990; Published by the American Radio Relay League.
Armada Magazine Advertisement, Mar. 1998.

* cited by examiner

*Primary Examiner*—Don Wong
*Assistant Examiner*—Trinh Do Dinh
(74) *Attorney, Agent, or Firm*—Renner, Kenner, Greive, Bobak, Taylor & Weber

(57) ABSTRACT

An antenna (20) operable over a predetermined range of frequency includes a transmission line (36), a transformer network (42) connected to one end of the transmission line, and at least one inductor-resistor network (46) connected to an opposite end of the transformer network. The inductor-resistor network (46) changes the effective electrical length of the antenna (20) such that as the frequency of operation changes, the current distribution above and below the inductor-resistor network changes in a corresponding manner. A second inductor-resistor network (56) may be serially connected to the other network (46), wherein both function to reduce the current thereabove. Accordingly, as the frequency of operation increases, the electrical height of the antenna decreases.

12 Claims, 14 Drawing Sheets

LOW PROFILE, BROAD BAND MONOPOLE ANTENNA WITH INDUCTIVE/RESISTIVE NETWORKS

TECHNICAL FIELD

The present invention relates generally to antennas used in mobile and/or military applications. More particularly, the present invention relates to a broad band antenna that provides an instantaneous bandwidth of about 482 Megahertz(MHz) between 30–512 MHz with a relatively low voltage standing wave ratio (VSWR) and high gain. Specifically, the present invention provides a monopole broad band antenna with a series of inductor-resistor networks which effectively change the electrical length of the antenna.

BACKGROUND ART

It is known that electromagnetic communication systems employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits must be switched, whether manually or electronically, with the instantaneous frequency used for communications. As such, it is imperative to have a single antenna reasonably matched and tuned to all frequencies throughout the broad frequency spectrum of interest. Although the art discloses such broad band antennas, such as exemplified in U.S. Pat. No. 4,958,164 and U.S. application Ser. No. 09/175,008, which are owned by Assignee of the present invention, these antennas provide a somewhat limited frequency range.

As is well known in the art, a thin linear monopole antenna is normally used in a manner that requires its electrical length to be a quarter wavelength or 90 electrical degrees. These antennas require a ground plane, which is a large plane of sheet metal, such as a car or vehicle body made of metal, to provide the other half of the antenna. Therefore, the characteristics of the ground dependent "quarter wave" antenna are well known.

In order to enable a thin linear monopole antenna to be multi-band, the known art teaches placement of "traps," which are parallel inductors and capacitors, at various places in series with thin linear radiators (conductors). Such a construction results in a monopole that can be used for several frequencies or very narrow bands of frequencies. Unfortunately, the useful bandwidths for this type of antenna are very narrow, usually on the order of KHz or 2–3 MHz. With this in mind, it would be presumed that additional traps in series at various points with the linear radiators should produce additional bandwidth. However, the number of traps is usually limited to 2 or 3. The reason for this is that adjustment of each trap to its specific frequency or operational bandwidth is interdependent on the adjustment of all the traps within the antenna.

The main purpose of utilizing a trap is to change the electrical length of the monopole radiator as the frequency of operation is changed. Moreover, at a specific trap's operational frequency or bandwidth, the current in the linear radiator physically above the trap in question, is reduced to or near zero so that the current distribution of the radiator physically below the trap in question is approximately that of a quarter-wave monopole radiator. In view of the interdependency of each trap in order to obtain a desired frequency bandwidth, there is currently not available in the art a linear monopole antenna with a bandwidth anywhere near 482 MHz. Nor is there available an antenna with such a wide bandwidth that also has a relatively low VSWR across the bandwidth.

DISCLOSURE OF INVENTION

It is thus an object of the present invention to provide a low profile, broad band monopole antenna for frequencies ranging between 30–512 MHz.

It is another object of the present invention to provide an antenna, as above, that operates within the desired bandwidth and requires no field adjustments of any kind that require tuning or power matching of the antenna at any specific frequency within the band of operation.

It is a further object of the present invention, as above, to provide an antenna that when measured on a standard reference 10'×10' metal ground plane placed 10' above the earth ground, does not exceed a VSWR of 4:1 across the very high frequency (VHF) band (30–108 MHz) and does not exceed a VSWR of 3:1 across the ultra high frequency (UHF) band from 108–512 MHz.

It is yet another object of the present invention, as set forth above, to provide an antenna which provides a line of sight, E-field radiation pattern that when measured on a standard metal ground plane placed 10' above earth ground and compared to resonant quarter wave radiators at any specific frequency within the 30–512 MHz bandwidth, has an E-field gain that is not less than (−11 db) below the reference quarter wave antenna.

It is yet another object of the present invention to provide an antenna, as set forth above, which provides high voltage protection of up to 20 KV rms 60Hz for personnel and equipment should a tip portion of a vehicle-mounted antenna's radiator come in contact with high voltage power lines.

It is still another object of the present invention to provide an antenna, as set forth above, which provides a transmission line connected to the appropriate transmit/receive equipment and which is enclosed within a flexible spring assembly.

It is still a further object of the present invention to provide an antenna, as above, with a base radiator and a tip radiator enclosed in a reinforced housing that is secured to the spring assembly.

It is an additional object of the present invention to provide an antenna, as above, with an unun transformer within the base radiator to transform the feed point of impedance of the antenna to impedances that meet the VSWR requirements.

It is still yet another object of the present invention, as above, to connect the unun transformer to a linear radiator and a parallel inductor-resistor network to assist in regulating the effective electrical length of the antenna.

It is yet another object of the present invention, as above, to connect the first inductor-resistor network to an additional linear radiator and a second parallel inductor-resistor network to further assist in adjusting the effective electrical length of the antenna.

It is still yet another object of the present invention, as above, to provide the antenna with a tip radiator that is connected to the second inductor-resistor network through a tip capacitor.

The foregoing and other objects of the present invention, which shall become apparent as the detailed description proceeds, are achieved by an antenna operable over a predetermined range of frequency, comprising a transmission line, a transformer network connected to one end of the transmission line, and at least one inductor-resistor network connected to an opposite end of the transformer network, at least one inductor-resistor network changing the effective electrical length of the antenna such that as the frequency of operation changes, the current distribution above and below the inductor-resistor network changes in a corresponding manner.

Other aspects of the present invention are attained by an antenna operable over a predetermined broad band and connected to a transmission line, comprising a tip radiator having a series capacitance, a base radiator connected at one to the tip radiator and at the other end to the transmission line, the base radiator changing the effective electrical length of the antenna such that as the frequency of operation changes, the current distribution along a length of the base radiator changes.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

PREFERRED EMBODIMENT FOR CARRYING OUT THE INVENTION

Figure 1:
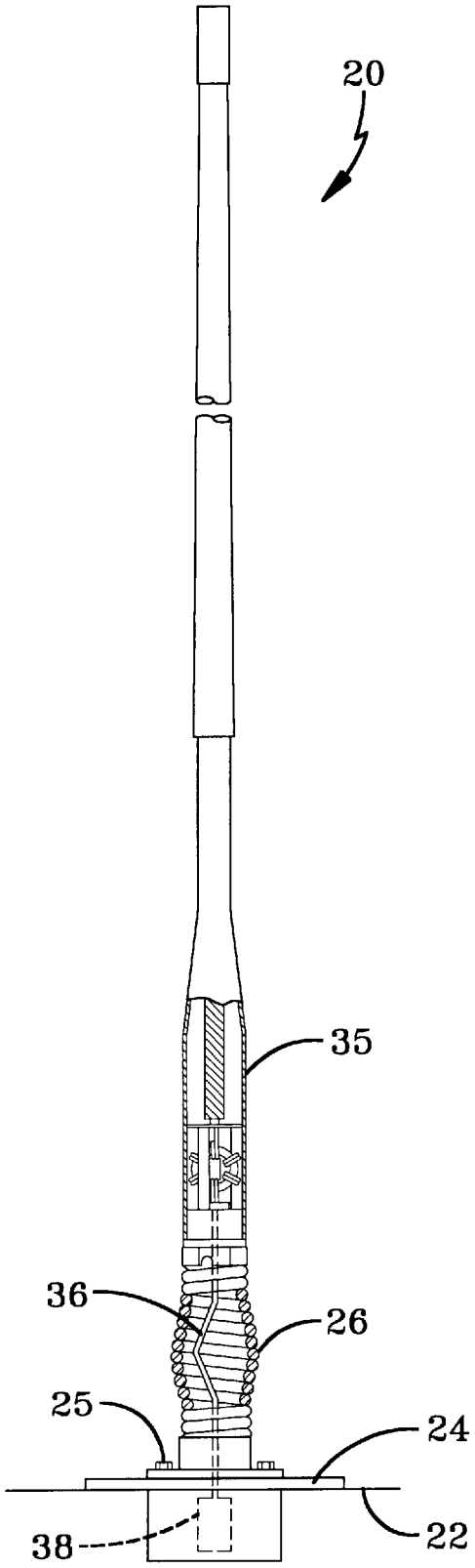
FIG. 1 is an elevational view, in partial cross-section, of an exemplary antenna according to the concept of the present invention.
Figure 2:
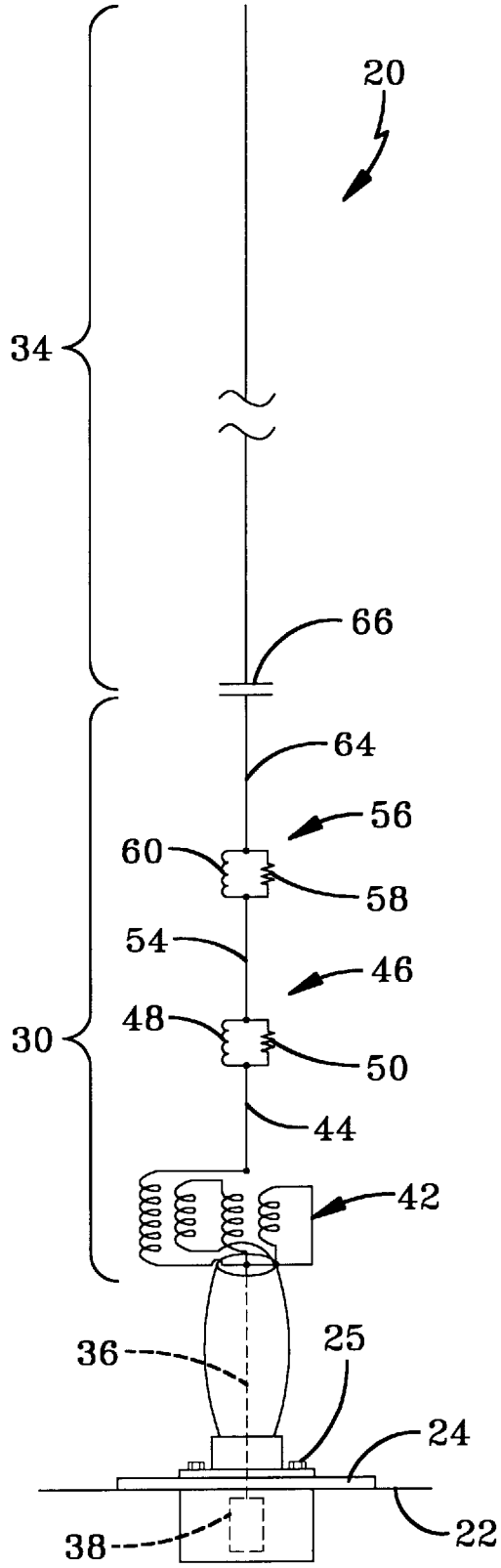
FIG. 2 is a schematic diagram of the electrical mode for the exemplary antenna depicted in FIG. 1.
Figure 3:
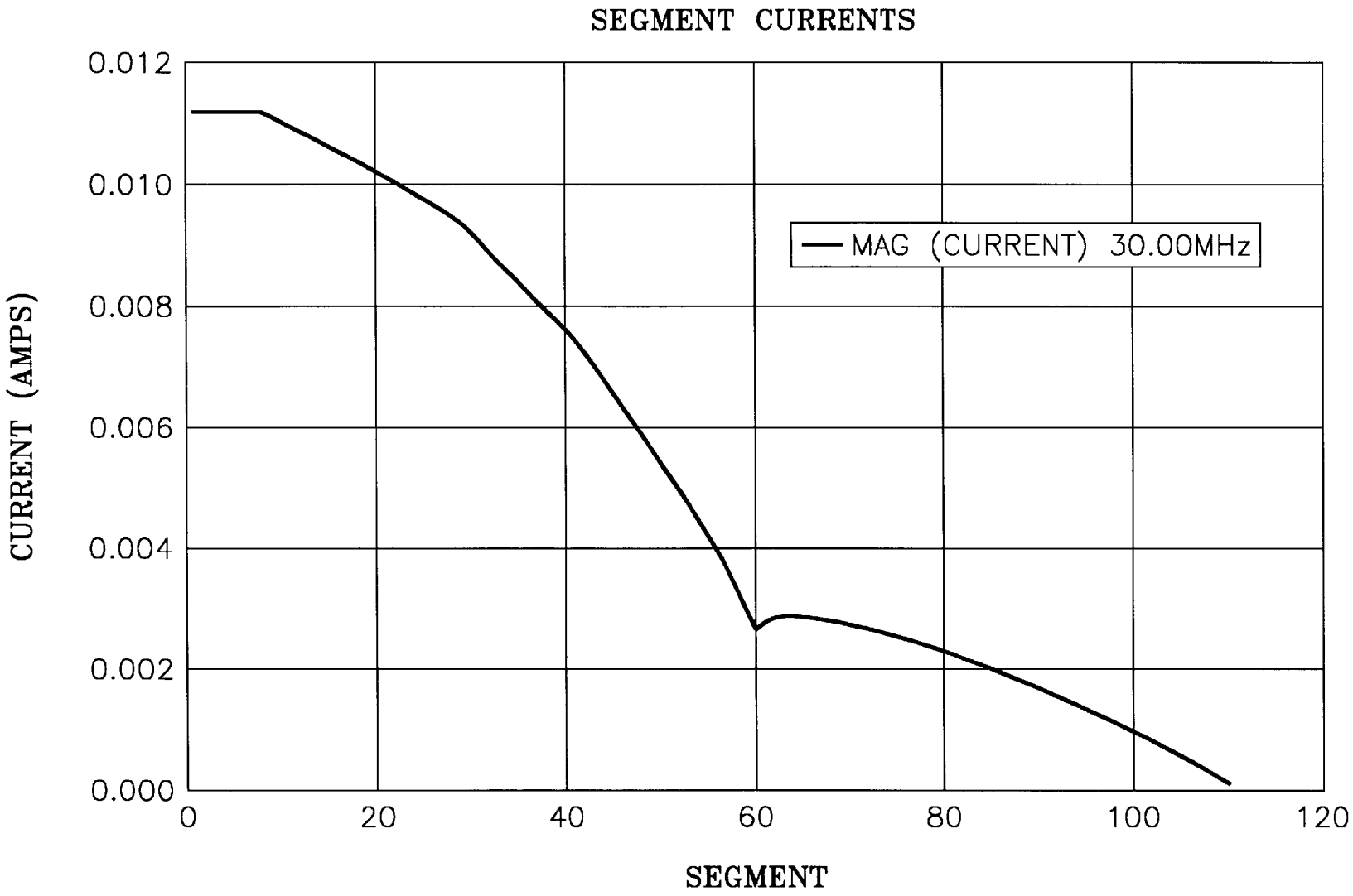
FIG. 3 is a plot of the computer-simulated currents along the length of the antenna operated at 30 MHz, wherein a segment is the linear distance along the antenna, in inches, as measured from the base.
Figure 4:
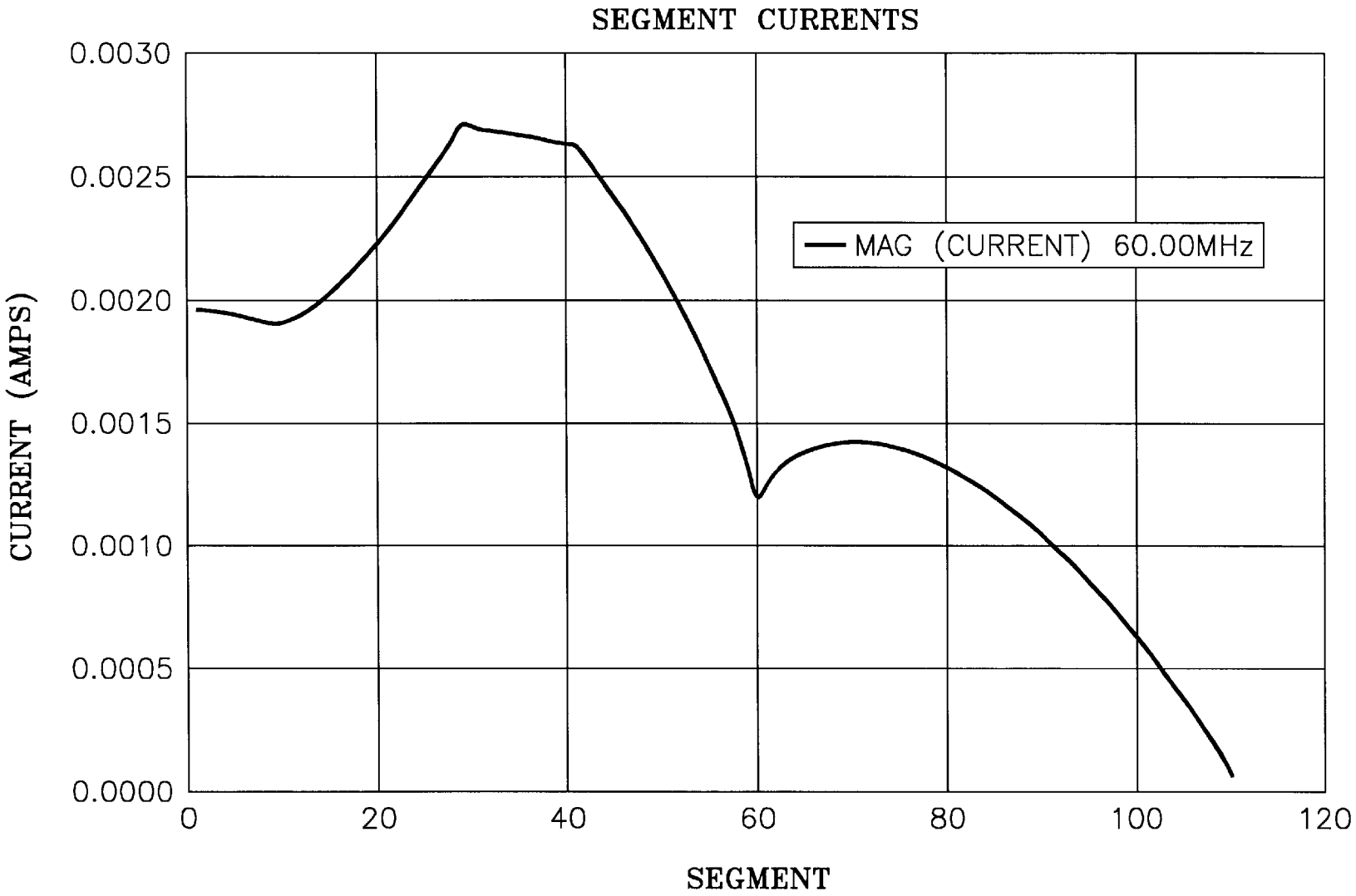
FIG. 4 is a plot of the computer-simulated currents along the length of the antenna operated at 60 MHz, wherein a segment is the linear distance along the antenna, in inches, as measured from the base.
Figure 5:
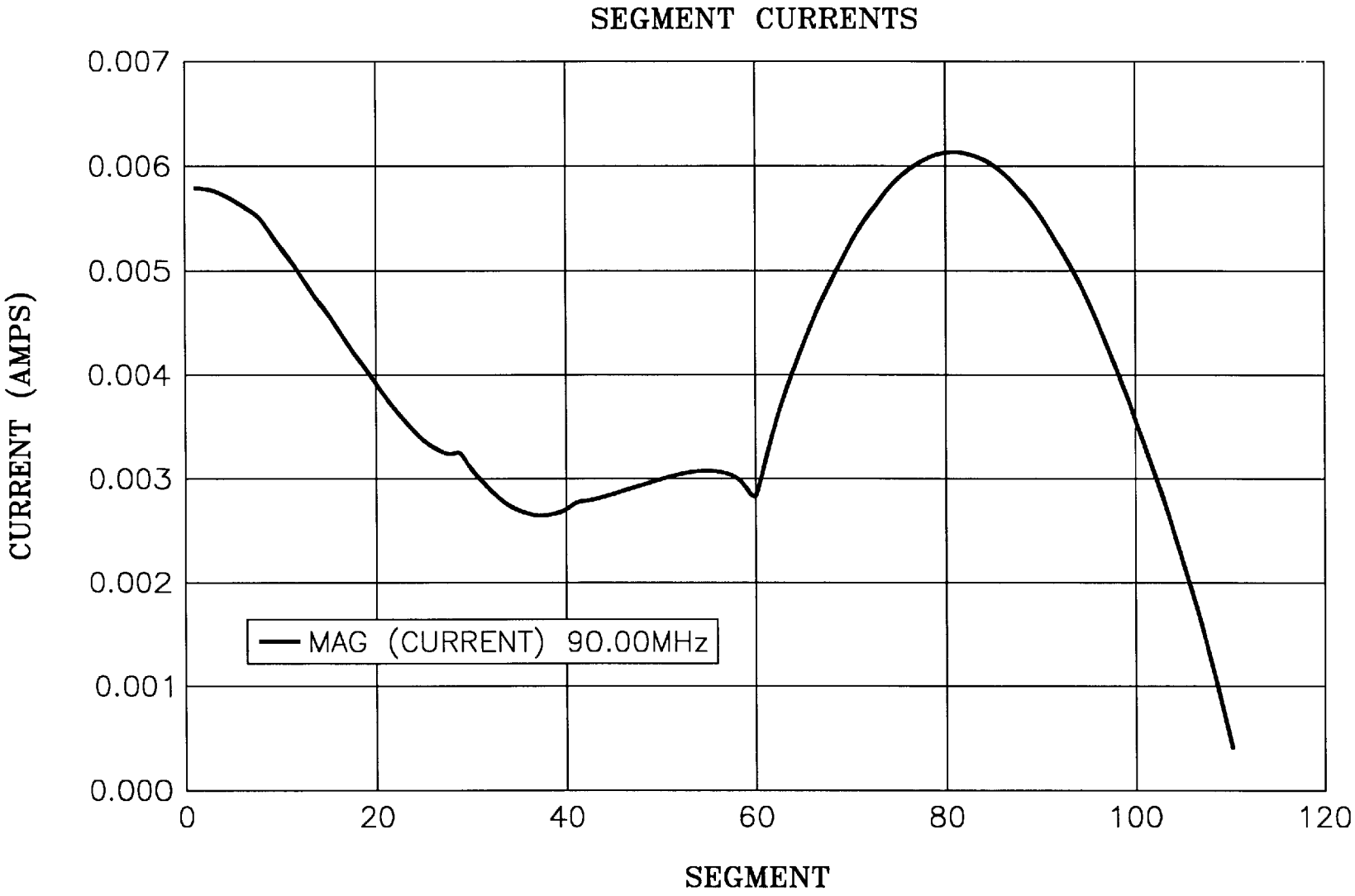
FIG. 5 is a plot of the computer-simulated currents along the length of the antenna operated at 90 MHz, wherein a segment is the linear distance along the antenna, in inches, as measured from the base.
Figure 6:
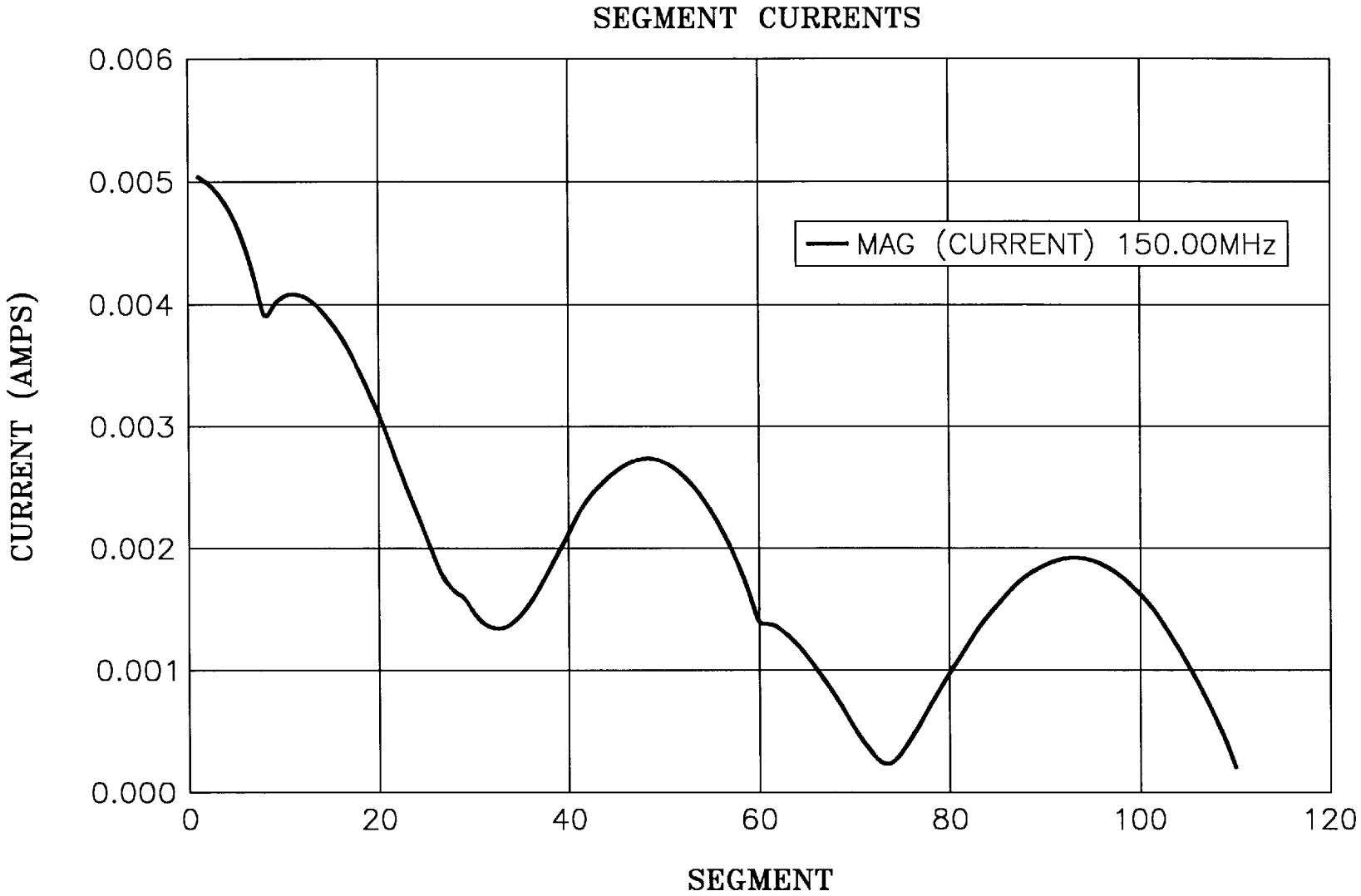
FIG. 6 is a plot of the computer-simulated currents along the length of the antenna operated at 150 MHz, wherein a segment is the linear distance along the antenna, in inches, as measured from the base.
Figure 7:
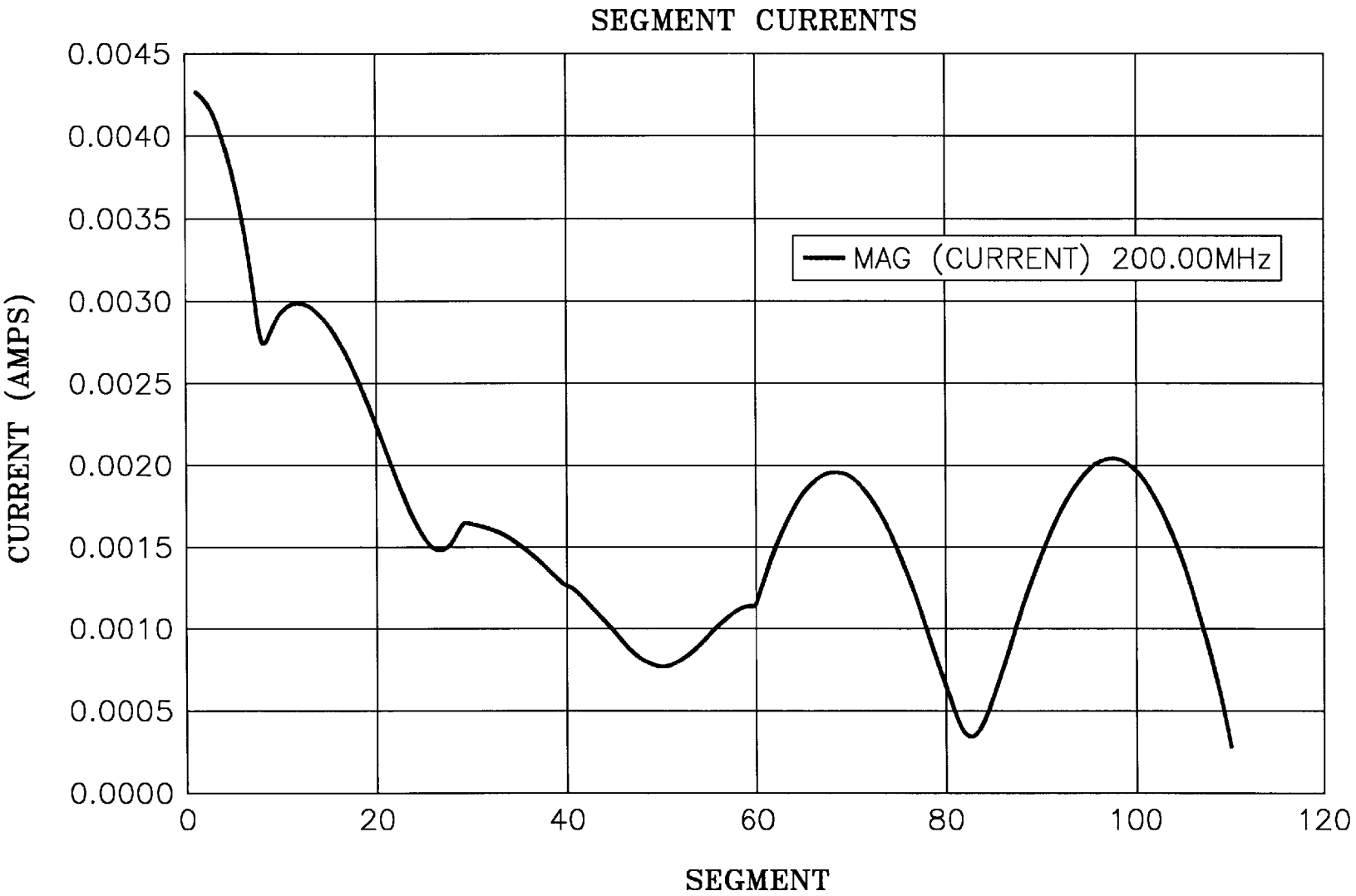
FIG. 7 is a plot of the computer-simulated currents along the length of the antenna operated at 200 MHz, wherein a segment is the linear distance along the antenna, in inches, as measured from the base.
Figure 8:
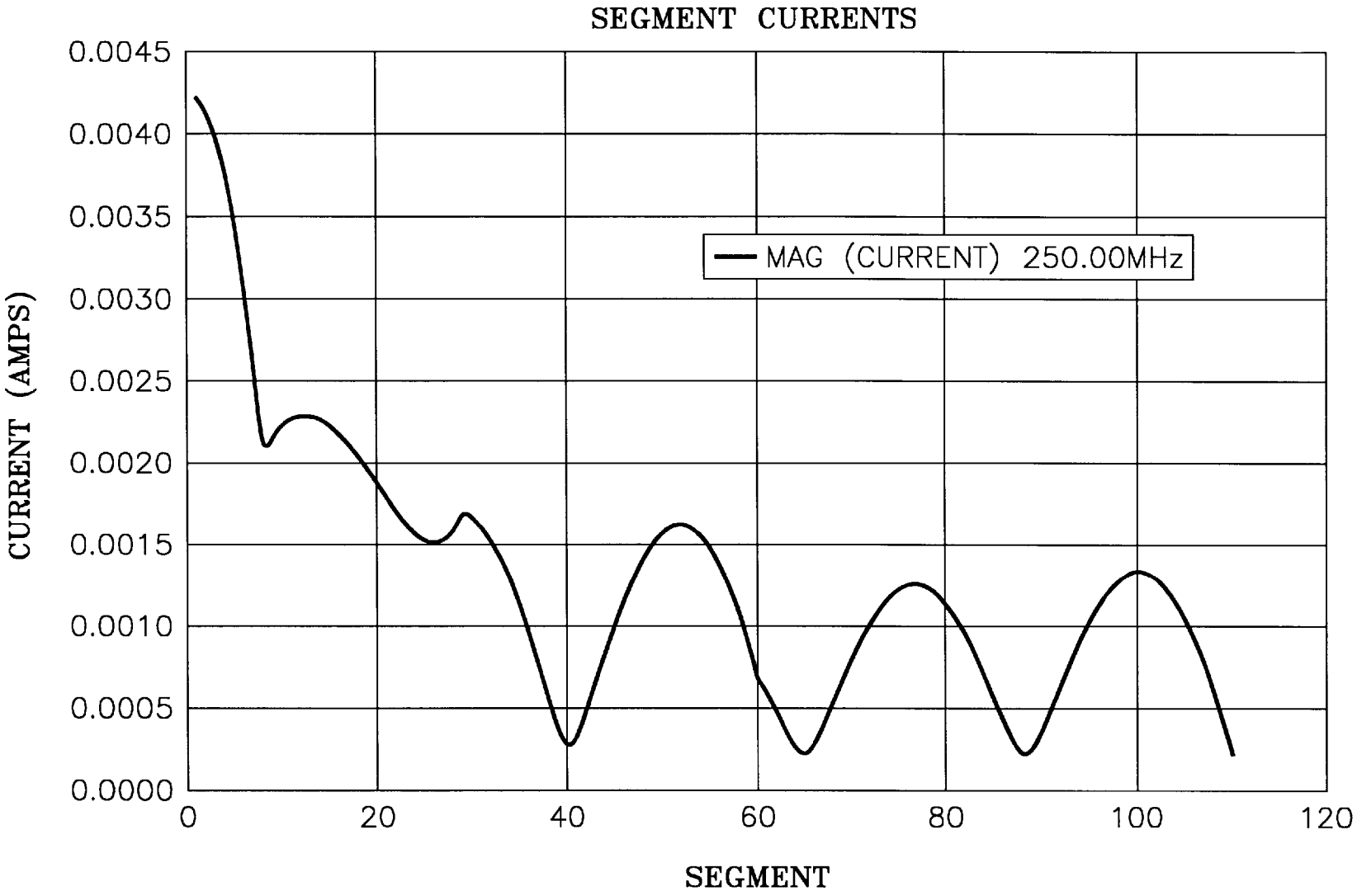
FIG. 8 is a plot of the computer-simulated currents along the length of the antenna operated at 250 MHz, wherein a segment is the linear distance along the antenna, in inches, as measured from the base.

Referring now to the drawings and, in particular, to FIGS. 1 and 2, a broad band antenna according to the present invention is generally indicated by the numeral 20. The antenna 20 is vertically secured to a mounting plane 22 which provides a sufficient ground plane, such as a military vehicle or the like. The antenna of the preferred embodiment is employed for ground-to-ground, ground-to-air communications, and, as will become apparent later, for satellite communication. The antenna 20 is secured to the mounting plane 22 by a base plate 24 with a plurality of fasteners 25 in a manner well known in the art. Extending substantially vertically from the base plate 24 is a spring assembly 26 which provides a flexible mounting for the antenna 20. The spring assembly 26 is preferably made of a corrosion-resistant steel, and is mechanically connected to the base plate 24 and the components of the antenna so as to withstand any flexure forces applied to the antenna.

Extending vertically from the spring assembly 26, in a direction away from the base plate 24, is a base radiator generally indicated by the numeral 30 and a tip radiator generally indicated by the numeral 34. Both the base radiator 30 and the tip radiator 34 are enclosed within a tapered cylindrical housing 35. The housing 35 is made of a non-conductive material such as fiber reinforced plastic and is enclosed within a fiberglass or plastic cover laminate.

A transmission line 36 which, in the preferred embodiment, is a length of 50 ohm characteristic impedance transmission line about 7 inches in length, is terminated at one end by a connector 38 typically used with 50 ohm transmission line such as SO239, BNC or a type N connector. The connector 38 is mounted to the base plate 24 and allows for connection to other transmitting or receiving equipment that utilizes the operational characteristics of the antenna 20.

The base radiator 30 includes an unun transformer 42 connected to the transmission line 36 at an end opposite the connector 38. In the preferred embodiment, the transformer is a Guanella 1:4 unun transmission line transformer. The transformer 42 transforms the feed point impedances of the antenna to impedances that meet the VSWR operational requirements of the antenna 20. Those skilled in the art will appreciate that the transformer includes a ferrite core. Selection of the ferrite core size, shape, and material depends upon the frequency range and VSWR requirements desired by the end-user and is easily done by one skilled in the art.

Published material such as *Transmission Line Transformers* by Jerry Sevick, published by the American Radio Relay League, is quite helpful in such selection.

Extending vertically from the transformer 42 are a series of linear radiators and electrical component networks which function in such a manner that as the frequency of operation changes, the impedance of the networks change instep and instantaneously to limit the antenna current(s) that exist above those networks; therefore, as the frequency of operation increases, the electrical height of the antenna in effect decreases. To accomplish this, the base radiator 30 includes a linear radiator 44 extending vertically from the transformer 42 and which is electrically connected to an inductor-resistor network 46. The network 46 includes an inductor 48 and a resistor 50 connected in parallel. In the preferred embodiment, the inductor 48 has a value of 0.39 $\mu$H and a Q value of about 93 at 25 MHz. The preferred value for the resistor 50 is 250 ohms rated at 20 watts, VSWR 1.15:1, frequency DC to 3.0 GHz, and capacitance 1.2 pf.

Extending vertically from network 46 is another linear radiator 54 which has connected to its opposite end an inductor-resistor network 56. The network 56 includes an inductor 58 and a resistor 60 connected in parallel. In the preferred embodiment, the inductor 58 has a value of 0.57 $\mu$H and a Q of 92 at 25 MHz. The resistor 60 has a value of 150 ohms rated at 20 watts, VSWR of 1.15:1, frequency DC to 3.0 GHz, and capacitance 1.2 pf. Vertically extending from the network 56 is another linear radiator 64. Those skilled in the art will appreciate that the linear radiators 44, 54, and 64 are typically brass tubes. In the preferred embodiment, the brass tube radiators have an outer diameter of 0.525 inches with a 0.014 inch wall thickness. Alternatively, the radiators could be constructed of a plurality of wires or conductors braided or spirally served around a core of dielectric material.

Extending from the linear radiator 64 is the tip radiator 34. A tip capacitor 66 is interposed between the linear conductor 64 and the tip radiator 34. In the preferred embodiment, the tip capacitor has a value of 4 pf. The tip capacitor 66 provides a safety factor for whenever the antenna 20 contacts a high voltage power line. The capacitor 66 and the fiberglass cover surrounding the tip radiator 34 provide a breakdown voltage of about 20 Kv rms, 60 Hz for personnel and/or equipment associated with the ground plane carrying the antenna 20.

With the foregoing structure of the antenna 20, it will be appreciated that the networks 46 and 56, along with their positional placement within the base radiator 30, provide the effective electrical lengths and current distribution changes needed to obtain the desired bandwidth of the antenna 20.

Simple circuit theory shows that for an ideal inductance in parallel with an ideal resistance, the equivalent impedance at any frequency is given by:

$$Zeq = \frac{RpXl^2}{Rp^2 + Xl^2} + j\mathrm{Rp}^2\frac{Xl}{Rp^2 + Xl^2} \tag{1}$$

which can be reduced to:

$$Zeq = \frac{Rp}{\frac{Rp^2}{Xl^2} + 1} + j\frac{Xl}{1 + \frac{Xl^2}{Rp^2}} \tag{2}$$

or $$Zeq = Req + jXeq \tag{3}$$

and $$Req = \frac{Rp}{\frac{Rp^2}{Xl^2} + 1} \tag{4}$$

and $$Xeq = \frac{Xl}{1 + \frac{Xl^2}{Rp^2}} \tag{5}$$

upon inspection at very low frequencies:
X1→0 and
Req→0
Xeq→X1

At very high frequencies:
X1→∞(very large values)
Req→Rp
Xeq→0 (very small values)

From the foregoing, it can be seen that the parallel inductance and resistance values of the networks 46 and 56 are chosen such that at the lower portion of the 30–512 MHz band, the networks reduce to an equivalent circuit that has a larger inductive reactance in series with a small resistance value. For example, at 30 MHz, the network 46 reduces to an equivalent series impedance of $Z_{eq}$=19.9+j67.6 (ohms). At 512 MHz, the network 46 reduces to an equivalent series impedance of $Z_{eq}$=240+j 48 (ohms). From these examples, it can be seen that at the lower end of the band, the antenna 20 is "inductively loaded" and at the higher end of the band, the antenna is "resistively loaded."

From the foregoing analysis, it should be apparent that as the frequency of the operation changes, the impedance of the networks 46 and 56 change instep and instantaneously in a way to limit the antenna current(s) that exist above those networks. Therefore, as the frequency of operation increases, the electrical height of the antenna effectively decreases. It will be appreciated by those skilled in the art that positional adjustment of the networks within the base radiator 30 and changes to the values of the components 48, 50, 58, and 60 correspondingly adjust the antenna's performance within the desired operating band. Of course, additional inductor-resistor networks could be positioned along the length of the antenna. In the preferred embodiment, the network 46 is positioned about 30 inches from the mounting plane and network 56 is positioned about 42 inches from the mounting plane. Accordingly, a change of network values and their placement along the antenna 20 could be adjusted such that the radiator pattern maximum load could be elevated (not along the line of sight) for ground to satellite communication.

Figure 9:
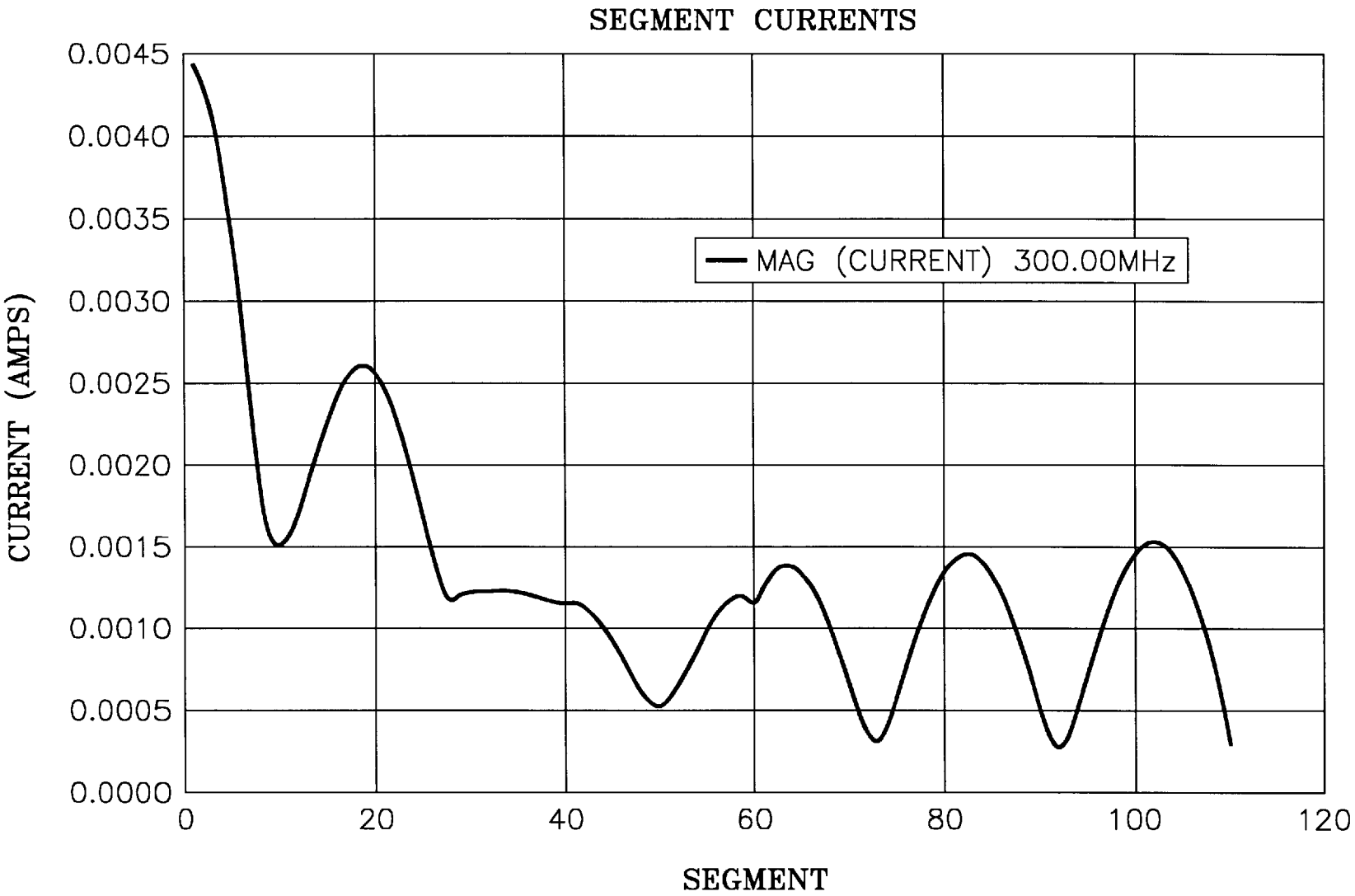
FIG. 9 is a plot of the computer-simulated currents along the length of the antenna operated at 300 MHz, wherein a segment is the linear distance along the antenna, in inches, as measured from the base.
Figure 10:
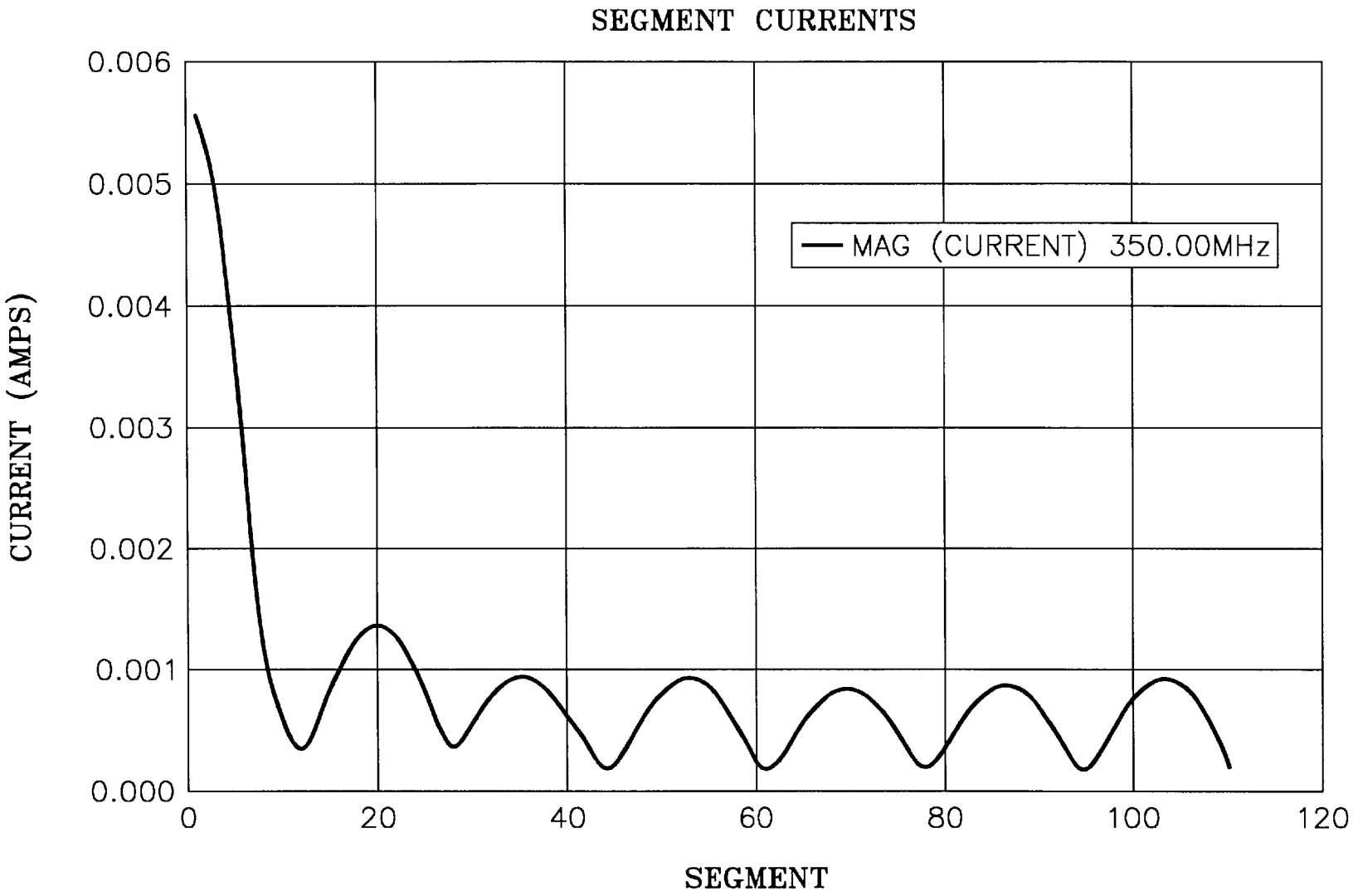
FIG. 10 is a plot of the computer-simulated currents along the length of the antenna operated at 350 MHz, wherein a segment is the linear distance along the antenna, in inches, as measured from the base.
Figure 11:
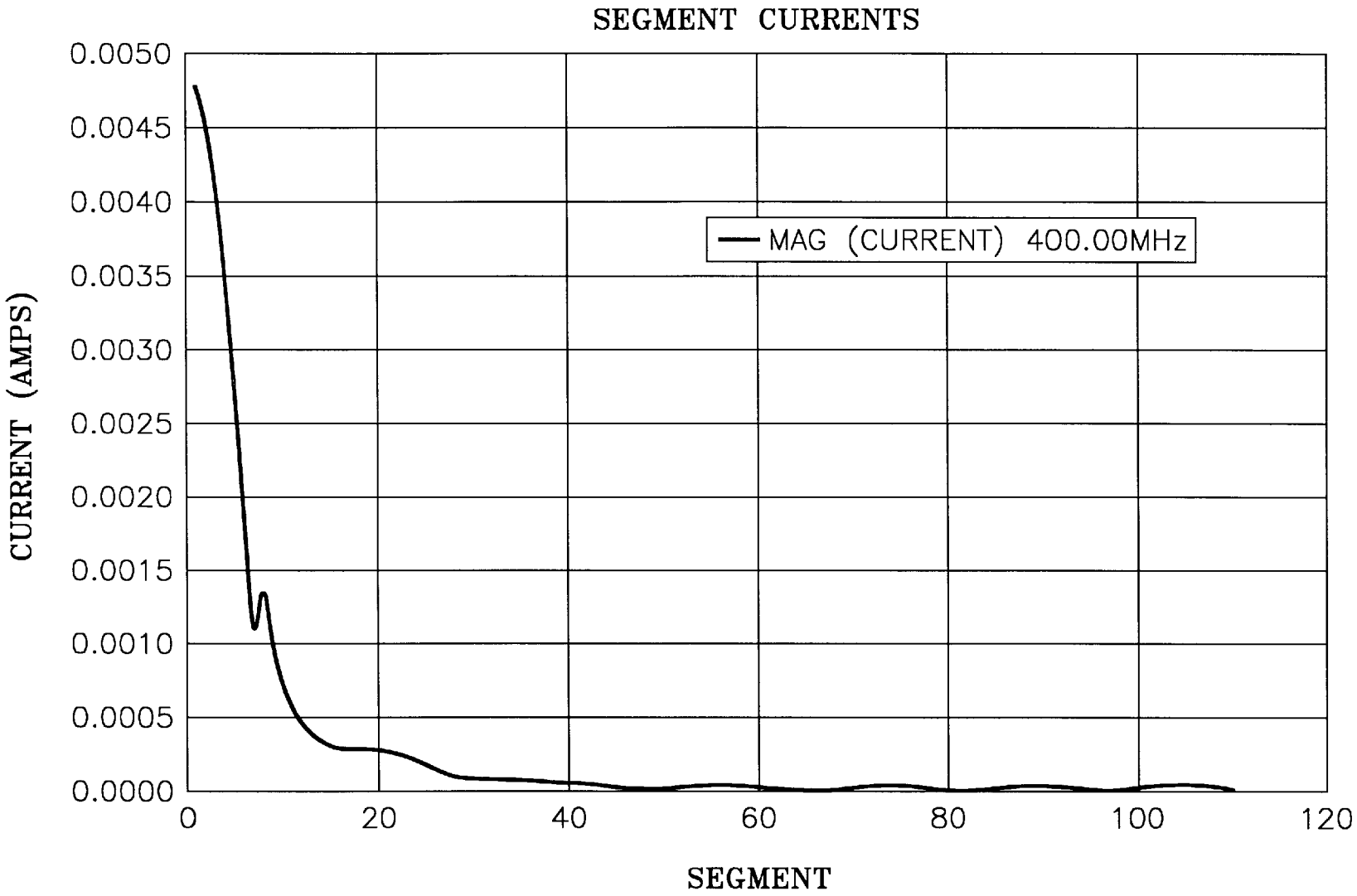
FIG. 11 is a plot of the computer-simulated currents along the length of the antenna operated at 400 MHz, wherein a segment is the linear distance along the antenna, in inches, as measured from the base.
Figure 12:
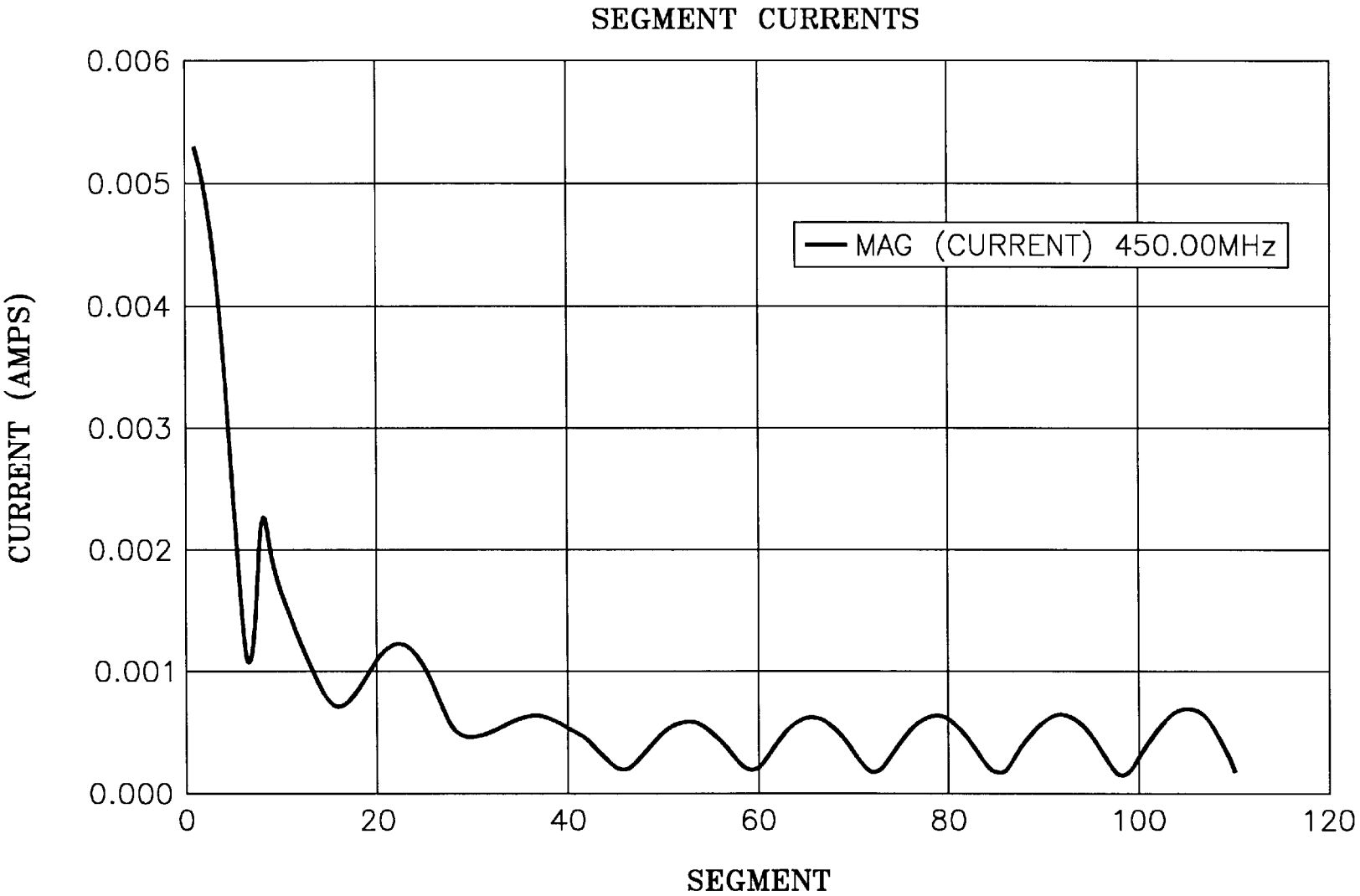
FIG. 12 is a plot of the computer-simulated currents along the length of the antenna operated at 450 MHz, wherein a segment is the linear distance along the antenna, in inches, as measured from the base.
Figure 13:
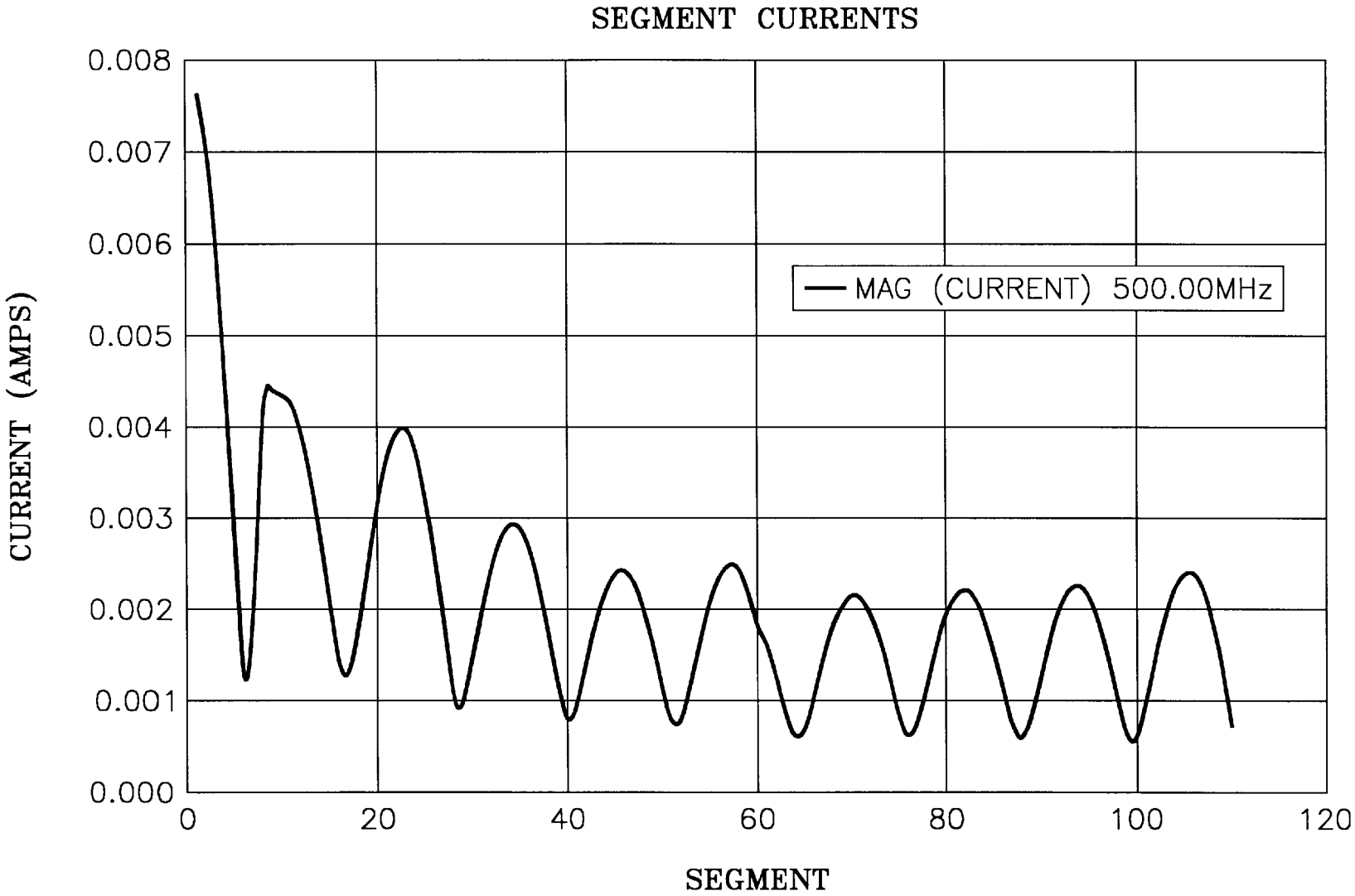
FIG. 13 is a plot of the computer-simulated currents along the length of the antenna operated at 500 MHz, wherein a segment is the linear distance along the antenna, in inches, as measured from the base.
Figure 14:
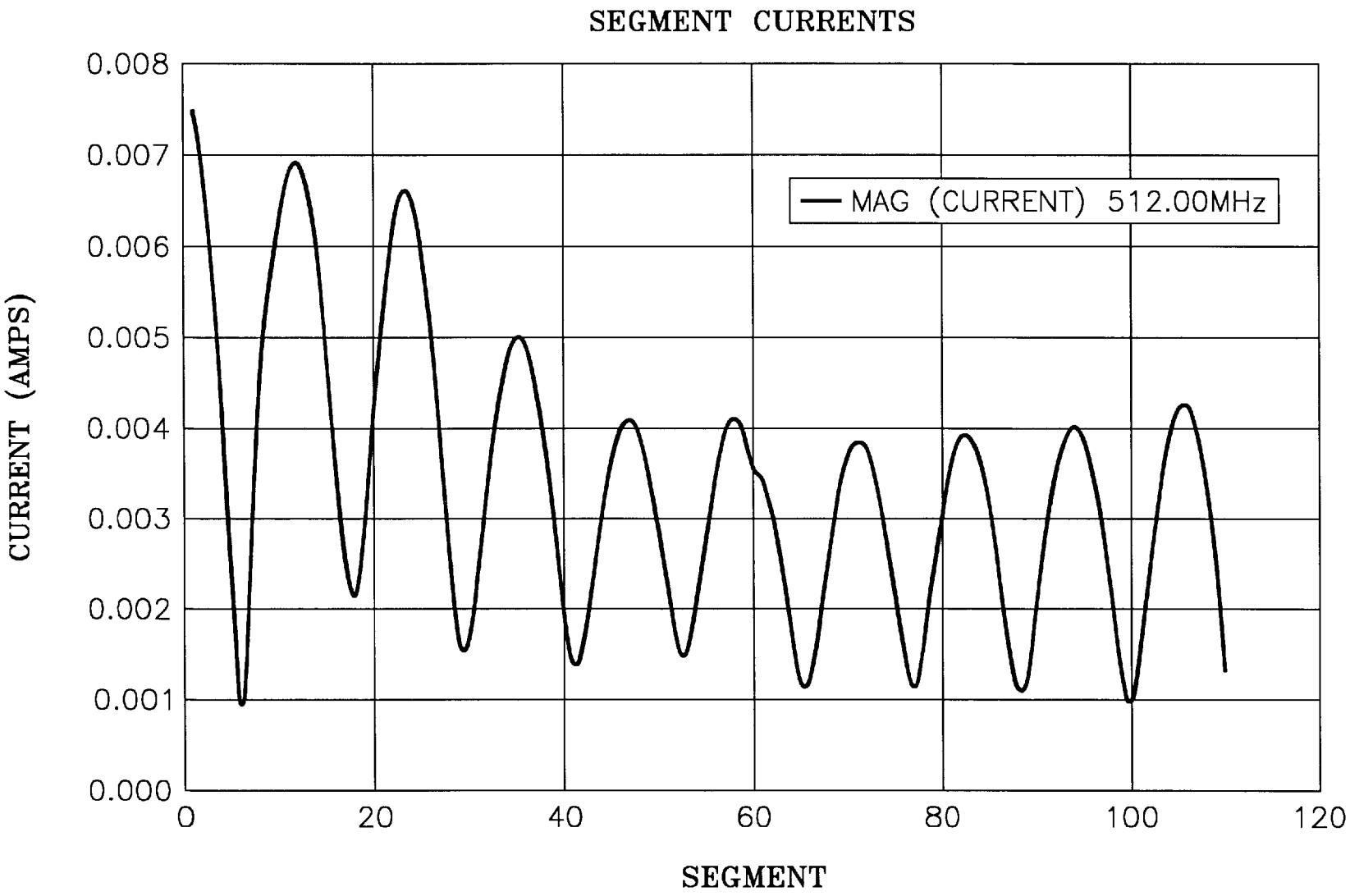
FIG. 14 is a plot of the computer-simulated currents along the length of the antenna operated at 512 MHz, wherein a segment is the linear distance along the antenna, in inches, as measured from the base.
Figure 15:
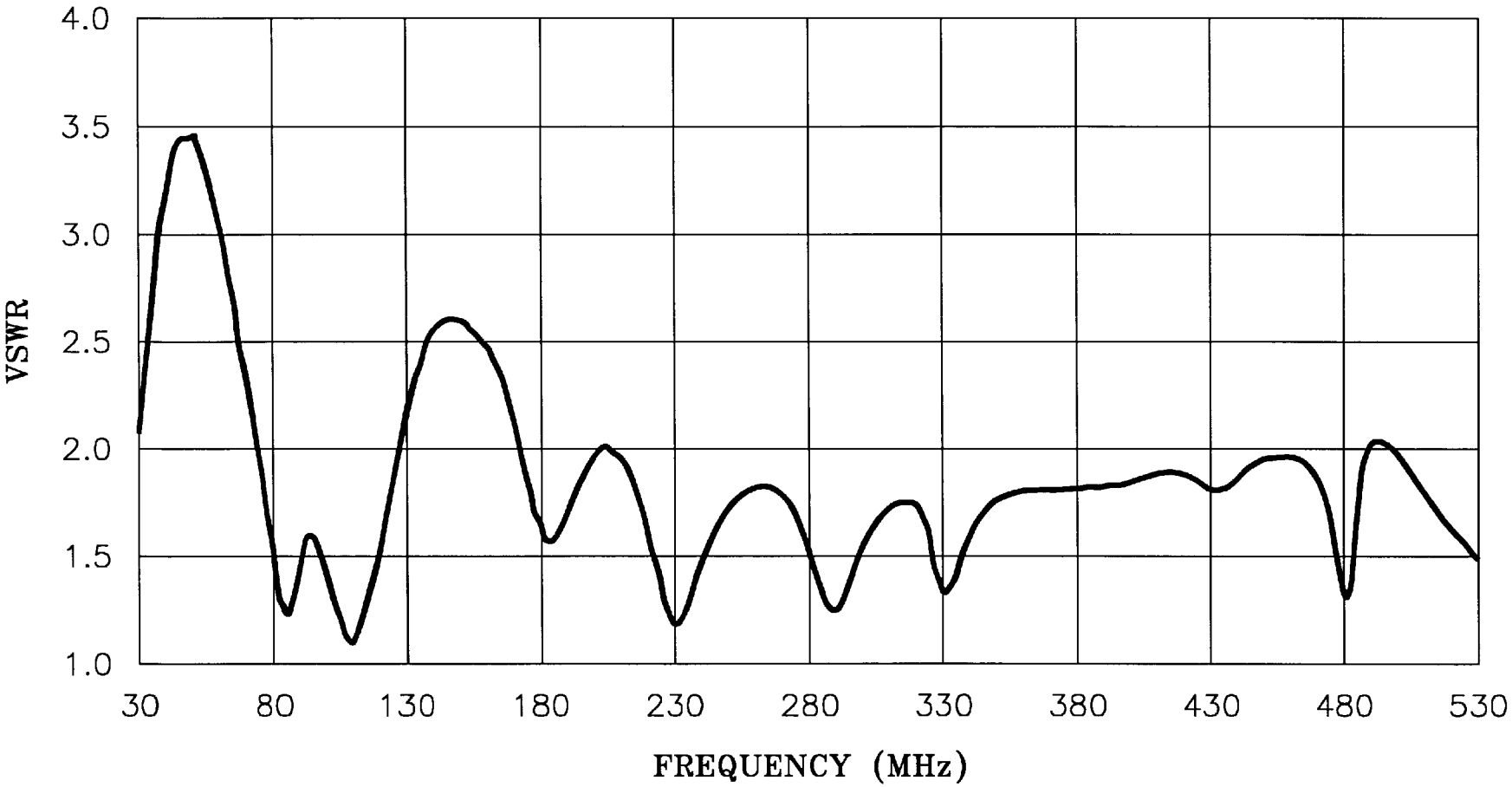
FIG. 15 is a plot of the computer-simulated VSWR versus frequency for the antenna of the present invention.

To further illustrate the effect of how the networks inserted within the base radiator 30 affect the current distribution along the antenna, a simple approximation of the antenna was modeled on a computer program "NEC-WIN PRO" which is an antenna analysis software package supplied by Nittanty Scientific, Inc. of Hollister, Calif. Accordingly, for the model antenna shown in FIGS. 1 and 2, FIGS. 3–14 show modeled current magnitude and distribution along the antenna for various frequencies. In other words, the vertical scales show the estimated current magnitude and the horizontal or segment scale shows the linear distance from the ground plane along the antenna in inches. For example, at 300 MHz, FIG. 9, the maximum current is approximately 0.0045 ampere and the maximum current above the network 46, at segment 30, is approximately 0.0015 ampere. Therefore, above the network, the currents have been reduced to a third of their maximum value or −9.5 db down. This results in less contribution to the far field radiation patterns by the current(s) above the network than by the current(s) below the network. It is submitted that the feature of current control by the two networks 46 and 56 results in a broad band or wide band antenna that meets the desired goals of the invention. The measured VSWR and gain performance of a preferred antenna utilizing the component values and positional placement of the networks as disclosed herein is provided in FIG. 15 and in Table 1, as measured on a 10'×10'×10' metal ground plane of a common antenna test range.

TABLE 1

Typical Antenna Gain

| FmHz | Gain (db) |
|---|---|
| 30 | −6.31 |
| 40 | −5.21 |
| 50 | −4.69 |
| 60 | −5.08 |
| 70 | −4.27 |
| 80 | −2.62 |
| 90 | −4.65 |
| 100 | −6.26 |
| 110 | −4.78 |
| 120 | −3.26 |
| 130 | −2.54 |
| 140 | −3.16 |
| 150 | −3.55 |
| 160 | −4.75 |
| 170 | −3.72 |
| 180 | −4.18 |
| 190 | −5.44 |
| 200 | −3.98 |
| 210 | −4.40 |
| 220 | −4.36 |
| 230 | −3.94 |
| 240 | −4.15 |
| 250 | −4.22 |
| 260 | −3.43 |
| 270 | −4.73 |
| 280 | −3.49 |
| 290 | −4.93 |
| 300 | −6.08 |
| 310 | −5.04 |
| 320 | −7.19 |
| 330 | −10.18 |
| 340 | −3.51 |
| 350 | −2.64 |
| 360 | −1.52 |
| 370 | −3.88 |
| 380 | −3.11 |
| 390 | −3.16 |
| 400 | −3.62 |
| 410 | −0.96 |
| 420 | −3.98 |
| 430 | −6.05 |
| 440 | −4.63 |
| 450 | −2.79 |
| 460 | −4.05 |
| 470 | −3.06 |
| 480 | −1.03 |
| 490 | −4.04 |
| 500 | −0.08 |
| 510 | +0.53 |
| 512 | −2.89 |

Based upon the foregoing, the advantages of the present invention are readily apparent. Primarily, the antenna 20 provides an instantaneous bandwidth of 482 MHz between the frequencies of 30–512 MHz. Moreover, this construction provides a VSWR of less than 4:1 for the VHF band (30–108 MHz) and a VSWR of less than 3:1 across the UHF band (108–512 MHz). Accordingly, use of the antenna 20 eliminates the need for special tuning circuits or the like and greatly improves the ability of transmitters and receivers to function without the need for tuning and other modifications.

Inasmuch as the present invention is subject to many variations, modifications and changes in detail, some of which have been expressly stated herein, it is intended that all matter discussed throughout this entire specification was shown in the accompanying drawings being interpreted as illustrative and not in a limiting sense. It should thus be evident that a device constructed according to the concepts of the present invention and reasonable thereto, will accomplish the objects of the present invention and otherwise substantially improve the broad band antenna art.

What is claimed is:

1. An antenna operable over a predetermined range of frequency, comprising:

a transmission line;

a transformer network connected to one end of said transmission line;

a linear radiator which includes within its length at least one inductor-resistor network, one end of said linear radiator connected to an opposite end of said transformer network, said at least one inductor-resistor network changing the effective electrical length of said linear radiator such that as the frequency of operation changes, the current distribution along said linear radiator, above and below said inductor-resistor network, changes in a corresponding manner, wherein the antenna has an instantaneous bandwidth of at least 58 MHz up to about 482 MHz in an overall bandwidth between 30 MHz and 512 MHz, wherein said at least one inductor-resistor network is an inductor and a resistor connected in parallel; and a second inductor-resistor network serially connected within said linear radiator, wherein said second inductor-resistor network is a second inductor and a second resistor connected in parallel, and wherein both said inductor-resistor networks function to reduce the current thereabove, such that as the frequency of operation increases, the electrical height of the antenna decreases.

2. The antenna according to claim 1, wherein the instantaneous antenna bandwidth is greater than 58 MHz anywhere between an overall antenna bandwidth of about 30 to 512 MHz with a Voltage Standing Wave Ratio of about 4.0 or less.

3. The antenna according to claim 1, further comprising a tip radiator connected to an opposite end of said linear radiator.

4. The antenna according to claim 1, wherein said inductor-resistor networks are positionally adjusted with respect to each other to change the antenna's radiation pattern.

5. The antenna according to claim 1, wherein unit values of said inductor-resistor networks are adjusted to change the antenna's radiation pattern.

6. An antenna operable over a predetermined broad band and connected to a transmission line, comprising:

a tip radiator having a series capacitance;

a base radiator connected at one end to said tip radiator and at the other end to the transmission line, said base radiator changing the effective electrical length of the antenna such that as the frequency of operation changes, the current distribution along a length of said base radiator changes;

a transformer network connected to the transmission line; and a series of linear radiators and inductive-resistive parallel networks connected to said transformer network, wherein said inductive-resistive parallel networks are connected between said series of linear radiators and function to reduce the current along the length of said series of linear radiators, such that as the frequency of operation increases, the electrical height of the antenna decreases, and wherein the antenna bandwidth is at least greater than 58 MHz up to about 482 MHz anywhere between an overall antenna bandwidth about 30 MHz to 512 MHz with a Voltage Standing Wave Ratio of about 3:5 or less.

7. The antenna according to claim 6, wherein said parallel inductor-resistor networks are positionally adjusted with respect to each other to change the antenna's radiation pattern.

8. The antenna according to claim 6, wherein unit values of said parallel inductor-resistor networks are adjusted to change the antenna's radiation pattern.

9. The antenna according to claim 6, wherein the bandwidth is greater than 58 MHz and is between an overall antenna bandwidth of about 30 MHz to 512 MHz with a voltage standing wave ratio no greater than 4:1 across a frequency band of 30 MHz to 108 MHz and no greater than 3:1 across a frequency band of 108 MHz to 512 MHz.

10. An antenna operable over a predetermined range of frequency, comprising:

a transmission line;

a transformer network connected to one end of said transmission line; and a linear radiator which includes within its length at least one inductor-resistor network, one end of said linear radiator connected to an opposite end of said transformer network, said at least one inductor-resistor network changing the effective electrical length of said linear radiator such that as the frequency of operation changes, the current distribution along said linear radiator, above and below said inductor-resistor network, changes in a corresponding manner, wherein the antenna has an instantaneous bandwidth of at least 58 MHz up to about 482 MHz in an overall bandwidth between 30 MHz and 512 MHz.

11. The antenna according to claim 10, wherein said at least one inductor-resistor network is an inductor and a resistor connected in parallel.

12. The antenna according to claim 10, wherein the bandwidth is greater than 58 MHz and is between an overall antenna bandwidth of about 30 to 512 MHz with a voltage standing wave ratio no greater than 4:1 across a frequency band of 30–108 MHz and no greater than 3:1 across a frequency band of 108–512 MHz.

* * * * *